US006209270B1

(12) United States Patent
Johnston

(10) Patent No.: US 6,209,270 B1
(45) Date of Patent: Apr. 3, 2001

(54) MULTILEVEL BUILDING WITH RAMP

(76) Inventor: Hugh W. Johnston, 3627 Sherwood Cir., Gastonia, NC (US) 28056

( * ) Notice: Subject to any disclaimer, the term of this patent is extended or adjusted under 35 U.S.C. 154(b) by 0 days.

(21) Appl. No.: 09/425,937

(22) Filed: Oct. 25, 1999

(51) Int. Cl.[7] ..... E04H 14/00
(52) U.S. Cl. ..... 52/175; 52/174; 52/33
(58) Field of Search ..... 52/174, 175, 176, 52/33; 414/227, 253, 229

(56) References Cited

U.S. PATENT DOCUMENTS

| | | | | |
|---|---|---|---|---|
| 1,432,132 | | 10/1922 | Sturges . | |
| 2,763,381 | | 9/1956 | Bowles . | |
| 2,908,946 | * | 10/1959 | Sullivan | 52/175 |
| 2,936,083 | | 5/1960 | Dahlman . | |
| 3,290,837 | | 12/1966 | Weston . | |
| 3,562,984 | * | 2/1971 | Merle | 52/175 |
| 3,824,752 | | 7/1974 | Weston . | |
| 4,424,651 | * | 1/1984 | Lee et al. | 52/175 |
| 4,752,876 | | 6/1988 | Couch et al. . | |
| 4,971,505 | | 11/1990 | Sawyer . | |
| 5,463,546 | | 10/1995 | Parkhurst . | |
| 5,614,703 | | 3/1997 | Martin et al. . | |
| 5,749,186 | | 5/1998 | Kaufman et al. . | |
| 5,850,753 | | 12/1998 | Varma . | |
| 5,979,754 | | 11/1999 | Martin et al. . | |

FOREIGN PATENT DOCUMENTS

| | | |
|---|---|---|
| 0410008A1 | 1/1991 | (EP) . |
| 6236488 | 8/1994 | (JP) . |
| 6240937 | 8/1994 | (JP) . |

OTHER PUBLICATIONS

Progressive Architecture, vol. XL, Issue #6, p. 80, Published Jun., 1959, "Park–Near–Your–Room To Be Feature Of San Francisco Hotel".

* cited by examiner

*Primary Examiner*—Christopher T. Kent
*Assistant Examiner*—Jennifer I. Thissell
(74) *Attorney, Agent, or Firm*—Bacon & Thomas, PLLC

(57) ABSTRACT

A multilevel building including a first row of personal occupancy spaces arranged on one side of one level of the building which is above ground level, a second row of personal occupancy spaces arranged on an opposite side of the one level of the building, an elevated street arranged on the one level of the building between the first and second rows of personal occupancy spaces, and at least one helical ramp for carrying a vehicle between the ground level outside the building and the elevated street inside the building.

20 Claims, 4 Drawing Sheets

MULTILEVEL BUILDING WITH RAMP

BACKGROUND OF THE INVENTION

1. Field of the Invention

This invention generally relates to static structures, and, more particularly, to multilevel buildings with ramps.

2. Description of Related Art

The demand for affordable, high-density housing and commercial office space in urban areas must often be delicately balanced against the availability of parking facilities nearby. In fact, real estate developers are often required to provide adequate parking facilities as part of any new development. Storage space for, and easy access to, vehicles such as automobiles, motorcycles, golf carts, bicycles, trucks, vans, buses and/or other personal transportation can often consume large amounts of valuable open space in close proximity to high-rise building. Consequently, many inner-city buildings are provided with garage facilities directly above or below the floors or levels which are occupied by the residences or businesses. Since these owners often prefer to be as far as possible from the noise and congestion at street level, garage facilities inside these buildings are typically provided on the lower levels, and often underground.

In this regard, U.S. Pat. Nos. 3,290,837 and 3,824,752 to Weston disclose multi-story buildings having parking facilities on the lower levels. However, such parking facilities generally have limited capacity due to the large, open central well. They can also are expensive to build and safely operate. Furthermore, users of the building are often inconvenienced by having to use multiple sets of stairs and/or elevators in order to move between the parking level and the level on which their home or office is located. Moreover, for building complexes with very large underground parking areas, it can often be difficult to find a parking space near the most convenient stairway or elevator. Consequently, a tenant may also have a long, and potentially dangerous, walk across the underground garage. However, drivers must often park several levels from their habitable space and must cross a central helical carriageway in order to reach the stairs or elevator in the parking area.

Numerous ideas have been proposed for allowing a building tenant to park closer to their residence or business in such buildings. For example, U.S. Pat. No. 5,749,186 to Kaufman et al. discloses a multi-story building complex with access between each garage parking deck and its corresponding floor of the building at the same elevation. However, this design requires separate parcels of land for the garage and building. Furthermore, some tenants may still have a long walk across the garage deck, the interconnecting platforms, and the breeze-ways in front of their units.

U.S. Pat. Nos. 2,936,083 to Dahlman and 4,971,505 to Sawyer disclose buildings in which building users may be able to park a bit closer to their destination inside a building. However, these designs require large and expensive vehicle elevator systems which must be waited on to provide drivers with access to the street and/or their parking spaces. "Progressive Architecture," Issue No. 6, June 1959, discloses a another proposed design for a hotel where seven of the fifteen guest/room floors have parking areas on the same level as the rooms. Guests arriving by car drive up ramps in the core of the structure in order to arrive at the floors on which their rooms are located. No other details about the internal structure of the building are provided.

U.S. Pat. No. 1,432,132 to Sturges, on the other hand, discloses a building with a rectangular driveway around all for sides of the building with two inclined sections and two horizontal sections on each level. A court in the center of the driveway is subdivided into offices or stores having entrances on the driveway. However, the driveway blocks at least some of the natural light that might otherwise reach these units and some units have floors that are inclined relative to the driveway and are therefore very difficult to climb onto. Furthermore, parking for these offices and stores is arranged on the outside edge of the building across the driveway further blocking what limited naturally light might reach the offices and stores and requiring pedestrians to cross two lanes of traffic in the building before reaching their destination.

BRIEF SUMMARY OF THE INVENTION

These and other disadvantages of prior technology are addressed by providing a multilevel building including a personal occupancy space on one level of the building which is above ground level, a vehicular parking space on the one level adjoining the personal occupancy space, and a first ramp arranged on an external face of the building for providing vehicular access to the parking space from the ground level outside the building. The first ramp may be a helical ramp. In addition, the building may include a moveable barrier, such as a gate, fence, or door, for controlling access to the one level from the first ramp and/or another moveable barrier for controlling access to the parking space from other areas on the one level of the building.

The building may also include a second helical ramp for providing vehicular access from the parking space to the ground level outside the building from the parking space. The second helical ramp may be arranged on an external face of the building which is on the same, or opposite, opposite face of the building from the first ramp. The building may further include an elevated street extending between said first and second helical ramps on the one level of the building. A second personal occupancy space may be provided on the one level of the building and this second personal occupancy space may adjoin the vehicular parking space on the one level of the building. Alternatively, the first and second personal occupancy spaces may be arranged on opposite sides of the elevated street on the one level of the building.

In another embodiment, the multilevel building includes a first row of personal occupancy spaces arranged along one side of one level of the building which is above ground level, a second row of personal occupancy spaces arranged along an opposite side of the one level of the building, an elevated street arranged on the one level of the building between the first and second rows of personal occupancy spaces, and means for carrying a vehicle between the ground level outside the building and the elevated street inside the building. For example, the vehicle carrying means may include an elevator or a ramp, and preferably at least one helical ramp arranged on an external face of the building. The vehicle carrying means may also include a second helical ramp arranged which is arranged on the same, or opposite, side of the building as the first helical ramp. The elevated street may be also be provided with amenities such as landscaping; lighting; ventilation; climate control; smoke, carbon monoxide, carbon dioxide, heat, and/or fire detection; emergency alarms, fire suppression; recreational equipment, and video and/or audio security systems.

In addition, the building may further include a first vehicular parking space arranged on the one level of the building adjoining the elevated street and also adjoining at least one of the personal occupancy spaces in the first row of personal occupancy spaces. A second vehicular parking space can also be similarly provided on the one level of the building adjoining said elevated street and also adjoining at least one of the personal occupancy spaces in the second row of personal occupancy spaces. At least one of these first and second vehicular parking spaces is preferably arranged between two personal occupancy spaces in one of the rows of personal occupancy spaces. A garage door may be provided for controlling vehicular access to this one parking space from the elevated street and another door may be provided between the one vehicular parking space behind the garage door and one of the two personal occupancy spaces on either side of this one vehicular parking space. Any of these doors may have locks and/or other security systems operated by keys, keypads, card keys, credit cards, smart cards, or electromagnetic transmission devices. Consequently, the personal occupancy space may be used as a residential living space, commercial space such as office or retail space, or a temporary accommodation space such as hotel or motel room.

BRIEF DESCRIPTION OF THE SEVERAL VIEWS OF THE DRAWINGS

The invention will now be described with respect to the drawings wherein the figures ("FIGS.") have been labeled with numerals identifying similar features throughout all of the figures, and wherein.

DETAILED DESCRIPTION OF THE PREFERRED EMBODIMENTS

Figure 1:
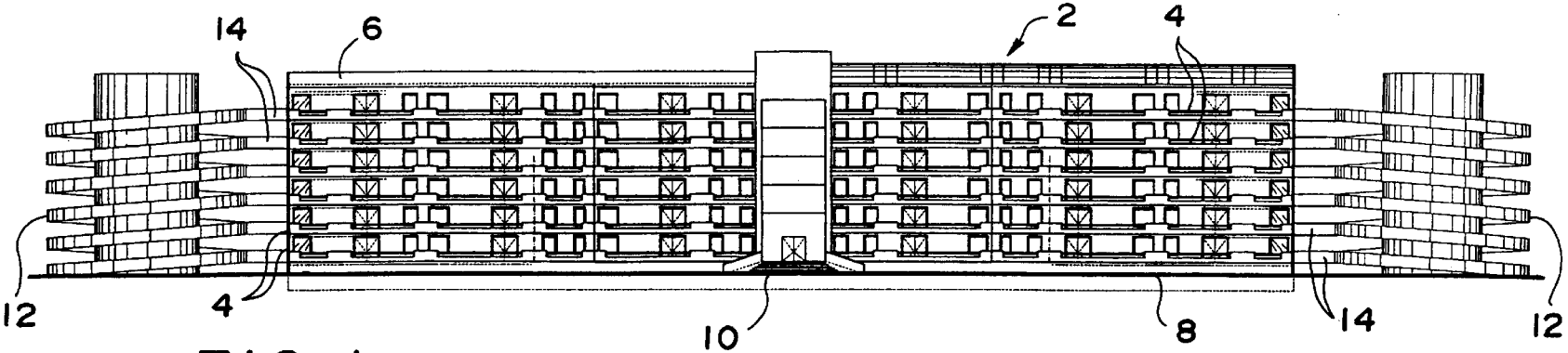
FIG. 1 is an elevational view of one embodiment of a multilevel building.

FIG. 1 is a front elevational view of one embodiment of a multilevel building 2. The building 2 has six levels, or above-ground floors, 4 and a roof level 6. Each of the levels 4 is preferably above ground level 8 and horizontal. However, the levels may also be inclined or staggered relative to horizontal or the ground level 8. Access to the building 2 is provided through a pedestrian entrance 10 in the center of the building 2 and a helical ramp 12 on each side of the building. The ramps 12 are preferably arranged on an external face of the building in order to maximize the amount of habitable space inside the building while providing access to and from the ground level 8 and each of the levels 4.

Figure 2:
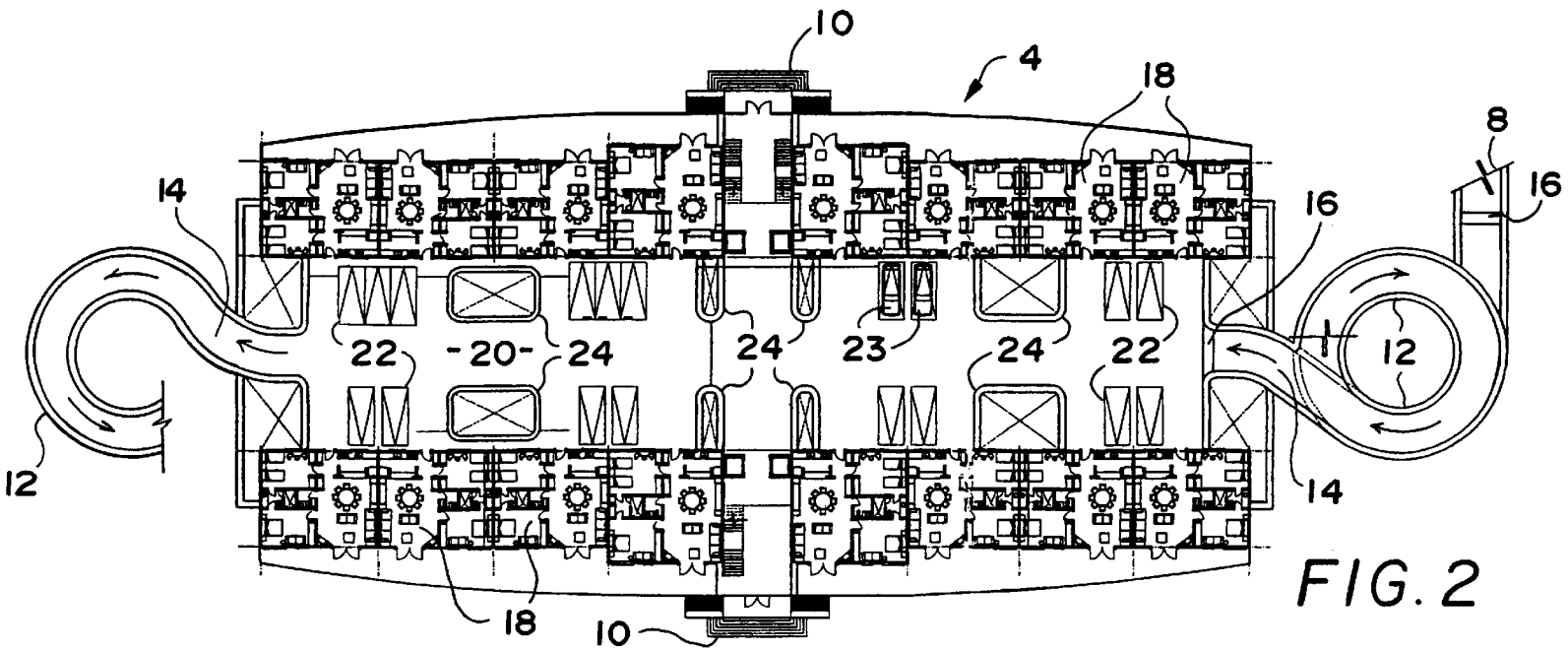
FIG. 2 is a plan view of one level of the building shown in FIG. 1.

FIG. 2 is a plan view of one of the levels 4 inside the multilevel building 2 shown in FIG. 1. The helical ramps 12 are illustrated as being circular spiral ramps; however, other ramp configurations may also be used such as oval, elliptical, rectangular, or other curved and/or polygonal shapes. Each of the ramps 12 provides access to or from the ground level 8 to an entrance or exit 14 on each of the levels 4. The ramps 12 are preferably sized to accommodate personal automobiles driving to and from the levels 4. However, the ramps 12 may also be configured for larger vehicles, such as vans, trucks, busses, or trolleys, or smaller vehicles, such as golf carts or bicycles. Alternatively, one of the ramps 12 may be sized to handle only pedestrian traffic, and/or wheelchairs, to and from each of the levels 4.

Instead of, or in addition to, the ramps 12, other means for carrying vehicles between the ground level 8 outside the building and higher levels 4 inside the building 2 may be also used, such as elevators, escalators, cranes, and/or other lifting devices. As illustrated by the arrows on the helical ramps 12, the helical ramps are preferably restricted to one-way traffic in opposite directions on each side of the building.

Each of the entrances and/or exits 14 on any of the levels 4 may be provided with a moveable barrier 16 in order to control access to the corresponding level 4 from the ramp 12. A variety of moveable barriers can be used, such as gates, fences, or doors. The barriers 16 may also be provided with security controls and/or communication systems near the corresponding entrance 14 in order to limit access to just the occupants of that level and their invited guests. In this way, each level can be operated as its own gated community. Similar barriers and/or security and communications systems may also be provided near the ground level 8 on each of the ramps 12 and/or the pedestrian entrance 10.

The levels 4 are provided with one or more personal occupancy spaces 18. Although the personal occupancy spaces 18 which are illustrated in the figures are shown as complete residential accommodations, they may also be just a portion of a larger accommodation arranged on more that one level 4 inside the building 2. The term "personal occupancy space" also includes retail space, office space or other commercial space such as warehouse or storage space. These personal occupancy spaces 18 are preferably arranged along the perimeter of the building 2 so as to allow for windows and/or balconies which provide natural light and ventilation into the each of the personal occupancy spaces. Also, the walls of the personal occupancy spaces are preferably load-bearing walls so as to minimize the otherwise usable space inside the building that is otherwise taken up by vertical structural supports.

In the preferred configuration shown in FIG. 2, two rows of personal occupancy spaces 18 are arranged along opposite sides of the building 2 and separated by an elevated street 20. In fact, each personal occupancy space 18 may be given an address corresponding to the elevated street 20 on a particular level 4. In FIG. 2, each of the personal occupancy spaces 18 is provided with an adjoining vehicular parking space 22 on the elevated street 20. However, fewer or greater numbers of vehicular parking spaces 22 may be provided for any of the personal occupancy spaces 18. With this arrangement occupants and/or their guests may drive their vehicles 23 up one of the helical ramps 12 and through the entrance 14 before parking in a parking space 22 adjoining their destination personal occupancy space 18. Certain areas of the level 4 may also be provided with curbs 24 to prevent vehicles from parking in those areas which may then be left open or filled with support structures or other equipment for operating the building 2. As described in more detail below with regard to FIGS. 3 and 4, "off-elevated-street" parking may also be provided.

Figure 3:
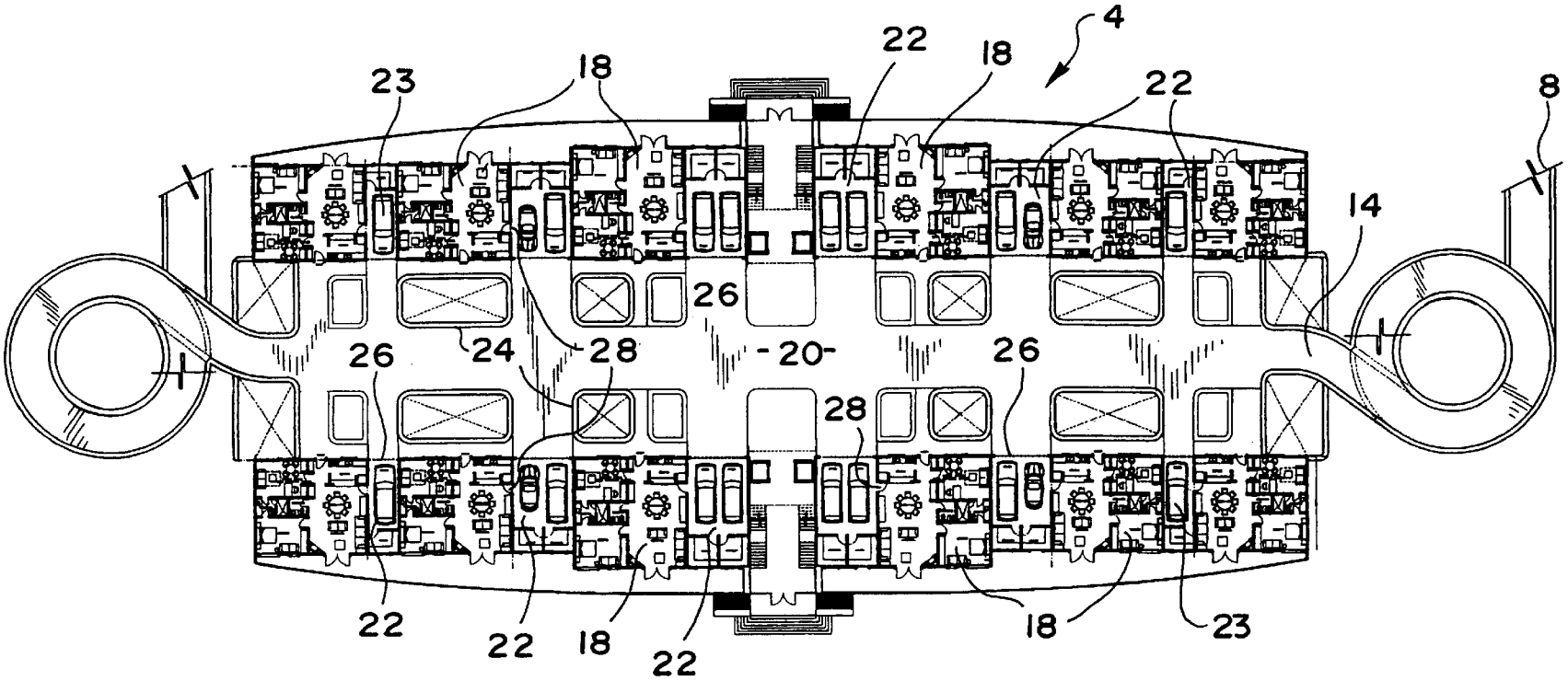
FIG. 3 is a plan view of one level of another layout of one level of the multilevel building in FIG. 1.

FIG. 3 is a plan view of another layout for a level 4 in the building 2 shown in FIG. 1. In FIG. 3, the vehicular parking spaces 22 are arranged between the personal occupancy spaces 18 on each side of the perimeter of the building so that the vehicles can be parked off of the elevated street 20. In addition, the vehicular parking spaces 22 shown in FIG. 3 are provided with garage doors 26 for controlling access to the parking spaces 22 and hiding the vehicles from view. Man doors 28 are also provided between the vehicular parking spaces 22 behind garage doors 26 and one of the adjoining personal occupancy spaces 18. Some of the personal occupancy spaces 18 in FIG. 3 are provided with vehicular parking spaces 22 for accommodating multiple vehicles 23 while others of the personal occupancy spaces are provided with vehicular parking spaces 22 for accommodating only one vehicle 23.

Figure 4:
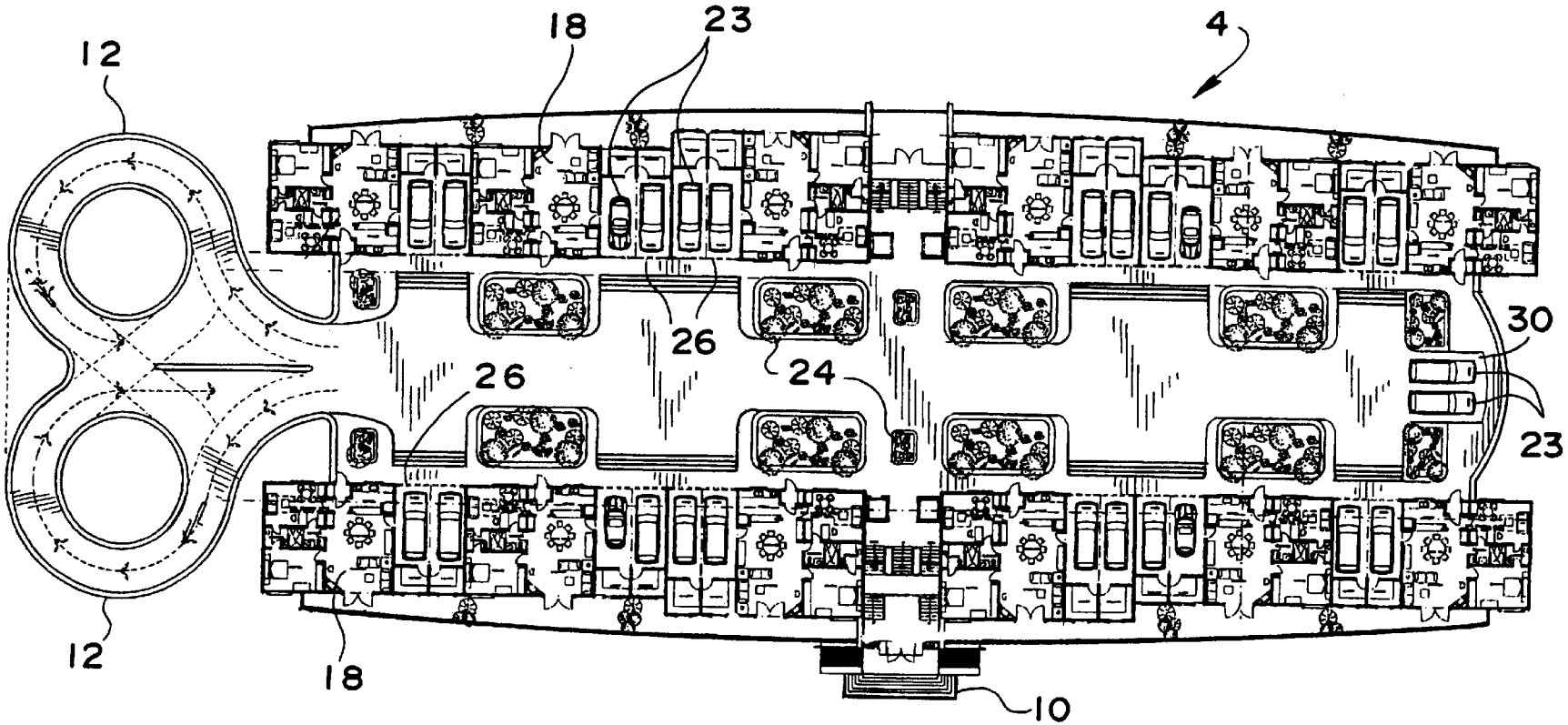
FIG. 4 is a plan view of one level of another embodiment of a multilevel building.

FIG. 4 is a plan view of one level 4 in another embodiment of a multilevel building. In this embodiment, each of the helical ramps 12 is provided on the same side of the building, and in a figure-eight configuration that minimizes the footprint of the ramps 12. In addition, although each of the personal occupancy spaces 18 is provided with an adjoining vehicular parking spaces inside a garage, additional elevated-street-level parking spaces 30 are also provided. In FIG. 4, the areas inside curbs 24 have been provided with landscaping. The elevated street 20 may also be provided with other amenities such as lighting; ventilation; climate control, smoke, carbon monoxide, carbon dioxide, heat, and/or fire detection; emergency alarms; fire suppression; recreational equipment; and security systems such as video, audio, key, and/or keypad controlled security systems.

Figure 5:
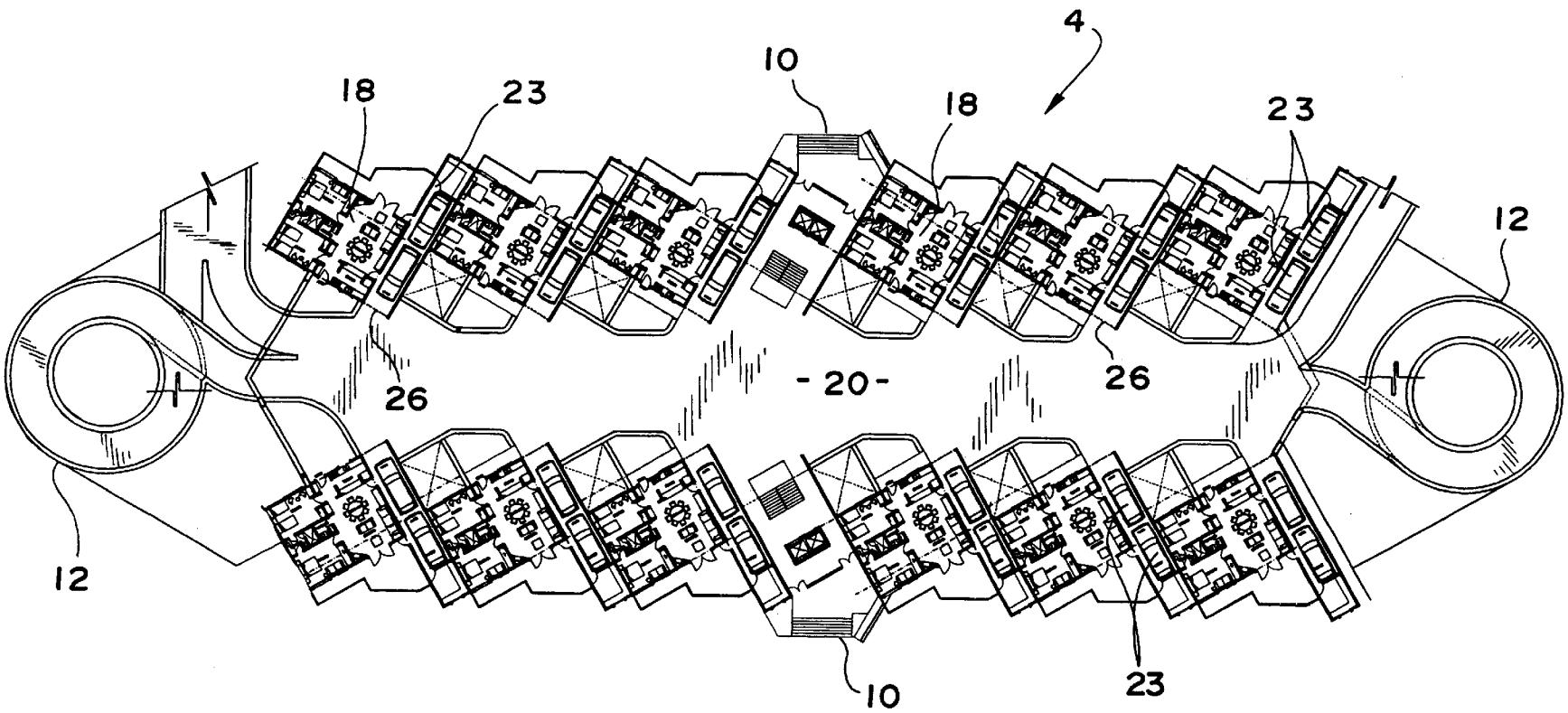
FIG. 5 is a plan view of one level of yet another embodiment of a multilevel building.

FIG. 5 is a plan view of one level of yet another embodiment of a multilevel building where the personal occupancy spaces 18 have been rotated on the level 4 and the vehicles 23 have been arranged end-to-end in order to provide additional area and privacy for each occupancy space.

The building 2 may be operated as a hotel or motel where at least some of the rooms are accessible by driving up the ramp 12 directly to a room near the elevated street 20. Alternatively, guests can park on the public street outside the hotel and use the pedestrian entrance 10. A credit card could be used for conveniently checking-in, checking-out, and as a room key in order to minimize the manpower that is otherwise required to operate a conventional hotel or motel. With a centralized reservation system, a franchise of such hotels or motels could be operated without accounting, sales, or other services personnel.

Although the invention has been described above with respect to various preferred embodiments, it would be readily understood by one of ordinary skill in the art that various changes and/or modifications may be made without departing from the spirit of the invention. It is intended that the scope of protection for the invention be limited only to the properly construed following claims.

What is claimed is:

1. A multilevel building, comprising a first row of personal occupancy spaces arranged along one side of one level of the building which is above ground level;

a second row of personal occupancy spaces arranged along an opposite side of the one level of the building;

an elevated street arranged on the one level of the building between the first and second rows of personal occupancy spaces;

a first helical ramp arranged on an external face of the building connecting the ground level outside the building and the elevated street inside the building, and a second helical ramp arranged on the same side of the building as said first helical ramp, said second helical ramp connecting the around level outside the building and the elevated street inside the building.

2. The building recited in claim 1 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

3. The building recited in claim 1, further comprising:

a first vehicular parking space on said one level of the building adjoining said elevated street and also adjoining at least one of the personal occupancy spaces in the first row of personal occupancy spaces; and a second vehicular parking space on said one level of the building adjoining said elevated street and also adjoining at least one of the personal occupancy spaces in the second row of personal occupancy spaces.

4. The building recited in claim 3 wherein at least one of said first and second vehicular parking spaces is arranged between two personal occupancy spaces in one of the rows of personal occupancy spaces.

5. The building recited in claim 4 further comprising a garage door for controlling vehicular access to said one parking space from the elevated street.

6. The building recited in claim 5 further comprising an door leading from said one vehicular parking space behind said garage door to one of the two personal occupancy spaces on either side of the one vehicular parking space.

7. The building recited in claim 3 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

8. The building recited in claim 4, wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

9. The building recited in claim 5, wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

10. The building recited in claim 6, wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

11. A multilevel building, comprising a first row of personal occupancy spaces arranged along one side of one level of the building which is above ground level;

a second row of personal occupancy spaces arranged along an opposite side of the one level of the building;

an elevated street arranged on the one level of the building between the first and second rows of personal occupancy spaces;

a first helical ramp arranged on an external face of the building connecting the ground level outside the building and the elevated street inside the building, and a second helical ramp arranged on an opposite side of the building from said first helical ramp, said second helical ramp connecting the ground level outside the building and the elevated street inside the building.

12. The building recited in claim 11, further comprising:

a first vehicular parking space on said one level of the building adjoining said elevated street and also adjoining at least one of the personal occupancy spaces in the first row of personal occupancy spaces; and a second vehicular parking space on said one level of the building adjoining said elevated street and also adjoining at least one of the personal occupancy spaces in the second row of personal occupancy spaces.

13. The building recited in claim 12 wherein at least one of said first and second vehicular parking spaces is arranged between two personal occupancy spaces in one of the rows of personal occupancy spaces.

14. The building recited in claim 12 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

15. The building recited in claim 13 further comprising a garage door for controlling vehicular access to said one parking space from the elevated street.

16. The building recited in claim 13 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

17. The building recited in claim 15 further comprising an door leading from said one vehicular parking space behind said garage door to one of the two personal occupancy spaces on either side of the one vehicular parking space.

18. The building recited in claim 15 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

19. The building recited in claim 17 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

20. The building recited in claim 11 wherein said elevated street is provided with amenities selected from the group consisting of landscaping; lighting; ventilation; climate control; smoke, carbon monoxide, carbon dioxide, heat, and/or fire detection; emergency alarms, fire suppression; recreational equipment, and video and/or audio security systems.

* * * * *